US009567193B2

(12) United States Patent
Schmid et al.

(10) Patent No.: US 9,567,193 B2
(45) Date of Patent: Feb. 14, 2017

(54) METHOD FOR CONTROLLING A LOAD-MOVING DEVICE AND CONTROLLER OF A LOAD-MOVING DEVICE

(75) Inventors: Josef Kaspar Schmid, Hohenems (AT); Manfred Schapler, Vandans (AT)

(73) Assignee: Liebherr-Werk Nenzing GmbH, Nenzing (AT)

( * ) Notice: Subject to any disclaimer, the term of this patent is extended or adjusted under 35 U.S.C. 154(b) by 1403 days.

(21) Appl. No.: 12/450,971

(22) PCT Filed: Apr. 18, 2008

(86) PCT No.: PCT/EP2008/003145

§ 371 (c)(1),
(2), (4) Date: Oct. 19, 2009

(87) PCT Pub. No.: WO2008/128724

PCT Pub. Date: Oct. 30, 2008

(65) Prior Publication Data

US 2010/0116767 A1 May 13, 2010

(30) Foreign Application Priority Data

Apr. 19, 2007 (DE) ..... 10 2007 018 646

(51) Int. Cl.
*B66C 13/40* (2006.01)

(52) U.S. Cl.
CPC ..... *B66C 13/40* (2013.01)

(58) Field of Classification Search
USPC ..... 212/284, 285, 290
See application file for complete search history.

(56) References Cited

U.S. PATENT DOCUMENTS 2,261,483 A * 11/1941 Nickles ..... 212/290
3,136,385 A * 6/1964 Eitel ..... 182/2.4
3,559,817 A * 2/1971 Brown ..... 212/285
(Continued)

FOREIGN PATENT DOCUMENTS

DE 10051449 4/2002
GB 1019648 2/1966
(Continued)

OTHER PUBLICATIONS

Machine translation of DE 10051449/EP1199278 from espacenet.com Sep. 7, 2013.*
(Continued)

*Primary Examiner* — Emmanuel M Marcelo
*Assistant Examiner* — Justin Stefanon
(74) *Attorney, Agent, or Firm* — John D. Russell

(57) ABSTRACT

The present invention comprises a method for controlling a load-moving device by at least two persons, with the following steps: controlling the movement of the load-moving device by a first person; handing over control over the movement of the load-moving device to a second person; controlling the load-moving device by the second person. The present invention furthermore comprises a corresponding controller of a load-moving device with a first, in particular permanently installed operating unit and a mobile operating unit for controlling the movement of the load-moving device for the safe and efficient performance of the method.

9 Claims, 2 Drawing Sheets

(56) References Cited

U.S. PATENT DOCUMENTS

| | | | | | |
|---|---|---|---|---|---|
| 3,757,895 | A * | 9/1973 | Knutson | 182/46 |
| 4,456,132 | A * | 6/1984 | LaValle et al. | 212/285 |
| 4,566,599 | A * | 1/1986 | Villa et al. | 212/285 |
| 4,614,274 | A * | 9/1986 | LaValle et al. | 212/285 |
| 5,022,543 | A * | 6/1991 | Versteeg | 212/271 |
| 5,402,257 | A * | 3/1995 | Hasselmann et al. | 398/109 |
| 6,405,114 | B1 * | 6/2002 | Priestley et al. | 701/50 |
| 6,474,922 | B2 * | 11/2002 | Bachman et al. | 414/21 |
| 6,634,514 | B2 * | 10/2003 | Ducrot | 212/285 |
| 7,831,364 | B2 * | 11/2010 | Bertsch et al. | 701/50 |
| 2011/0112731 | A1 * | 5/2011 | Harada | 701/50 |

FOREIGN PATENT DOCUMENTS

| | | | |
|---|---|---|---|
| JP | 606587 | A | 1/1985 |
| JP | 6112592 | A | 1/1986 |
| JP | 64591 | U | 1/1989 |
| JP | 01285594 | A | 11/1989 |
| JP | 08-143274 | | 6/1996 |
| JP | 2004250118 | | 9/2004 |
| WO | 2007/002675 | | 1/2007 |

OTHER PUBLICATIONS

ISA European Patent Office, International Search Report of PCT/EP2008/003145, Aug. 26, 2008, WIPO, 4 pages.
ISA German Patent and Trademark Office, Search Report of DE 10 2007 018 646.2-22, Nov. 13, 2007, 4 pages.
Japanese Patent Office, Notice of Reasons for Rejections of JP2010503420, Oct. 16, 2012, 15 pages.

* cited by examiner

METHOD FOR CONTROLLING A LOAD-MOVING DEVICE AND CONTROLLER OF A LOAD-MOVING DEVICE

CROSS-REFERENCE TO RELATED APPLICATIONS

This is the U.S. National Phase of International PCT Application Serial No. PCT/EP2008/003145, filed Apr. 18, 2008, which claims priority to German Patent Application No. 10 2007 018 646.2, filed on Apr. 19, 2007, both of which are hereby incorporated by reference in their entirety for all purposes.

TECHNICAL FIELD

The present invention relates to a method for controlling a load-moving device and a controller of a load-moving device. A load-moving device in the sense of the present invention is any kind of cargo handling or conveying device, in particular cranes and excavators. Particularly advantageously, the controller of the invention is used in crawler cranes, mobile cranes, cable excavators, harbor and ship cranes.

BACKGROUND AND SUMMARY

It is characteristic for great load-moving devices such as crawler cranes that the control station of the machine is very far away from the load to be positioned. Since in many cases the machine operator cannot see the load or the part of the load which is decisive for positioning, a banksman frequently is employed, who by means of hand signals shows to the crane operator in what direction the load must be moved. In many cases, however, the banksman cannot be positioned such that he both has a good view of the load and yet is visible and recognizable for the crane operator. For this reason, radio sets frequently are used now for communication between banksman and machine operator. In this connection it is disadvantageous that the crane operator must correctly interpret an acoustic message, which especially as regards the direction to be taken is much more difficult and error-prone than the known hand signals.

Known radio remote controls, e.g. for tower cranes, by means of which the machine operator himself instead of the banksmen can perform fine positioning of the load, are no remedy, since the operator then would no longer have the overview necessary for otherwise moving the load.

Therefore, it is the object of the present invention to provide a method for controlling a load-moving device and a corresponding controller of a load-moving device, which provide for a safer and more efficient movement and positioning of the load.

In accordance with the invention, this object is solved by a method for controlling a load-moving device by at least two persons, with the following steps: controlling the movement of the load-moving device by a first person; transferring control over the movement of the load-moving device to a second person; controlling the load-moving device by the second person. By means of the method of the invention it is possible to make the movement of the load-moving device safer and more efficient, wherein in particular both an efficient movement and a precise positioning of the load is possible. Management and control of the load-moving device always can be carried out by the person which has a better view of the load or the part of the load which is decisive for positioning. In particular, a banksman can therefore be omitted and misunderstandings between the two machine operators can be prevented.

Furthermore advantageously, the method of the invention comprises the step of transferring control over the movement of the load-moving device back to the first person. Thus, a typical operation can for instance consist in that the load is exerted by the first person, which usually operates a permanently installed operating unit, until the second person has a better view of the load. Thereupon, the second person, which usually operates a mobile operating unit, takes control over the load-moving device and positions the load, possibly also outside the field of view of the first person. Then, the load-moving device can again be positioned by the second person such that the first person has a good view, whereupon the first person again takes control over the load-moving device.

Advantageously, controlling the load-moving device is effected by the first and second persons via a first, advantageously permanently installed, and a second, advantageously mobile operating unit. The first operating unit thus can represent the usual control station of the load-moving device, which is operated by the machine operator, whereas the second person, which for instance is closer to the region in which the load should be positioned, can control the load-moving device via the mobile operating unit. Transferring control over the movement of the load-moving device in accordance with the invention thus provides for working both efficiently and precisely, so that misunderstandings, e.g. between a banksman and a machine operator, are excluded.

Advantageously, control transfer is effected by means of control commands of the first and/or second person, by which control over the movement of the load-moving device is transferred from the first to the second or from the second to the first operating unit. When transferring control over the movement of the load-moving device, the actuators on the operating units, which serve to actuate the machine movement, thus are deactivated on the one operating unit and activated on the other operating unit.

Advantageously, transferring control over the movement of the load-moving device requires a control command each of the person operating the mobile operating unit. Since the person with the mobile operating unit usually is positioned close to the load and thus is particularly endangered, this ensures that this person cannot loose control over the load-moving device without action on his part.

Furthermore advantageously, handing over control over the movement of the load-moving device requires a control command each of the person currently exerting control over the movement of the load-moving device. In this way, it is ensured that the person which currently controls the load-moving device cannot be deprived of this control without his consent. This increases the safety of the method of the invention, since misunderstandings thus are prevented.

Furthermore advantageously, taking control over the movement of the load-moving device requires a control command each of a person which should take control over the movement of the load-moving device. It thus is ensured that control is not assigned to an operating unit, without the person operating this operating unit being prepared for takeover.

Advantageously, transfer of control over the movement of the load-moving device hence is effected in that control each is handed over by the active operating unit by means of a control command and thereupon is taken over by an inactive operating unit by means of a further control command. Misunderstandings thereby are excluded, since transferring control over the load-moving device requires control commands of both persons between which control is transferred.

In the present invention, the transfer of control over the movement of the load-moving device advantageously also can be effected each by a control command of the person operating the mobile operating unit. Hence the same possesses a master function, by means of which the transfer of control to the individual operating units is actuated. Since this person usually is positioned in the working area of the load-moving device, he can also possess the power of decision on the allocation of control to the operating units, since he can decide best when a safe transfer of control is possible. Advantageously, control is transferred from the one operating unit to the other operating unit by means of the control command.

Furthermore advantageously, an emergency stop of the load-moving device can, however, be triggered at any time by the first and/or the second person. In this way, it is ensured that the emergency stop can be triggered at any time independent of which person has control over the load-moving device, which prevents for instance that the person operating the mobile operating unit is injured due to operating errors of the person operating the first operating unit.

Advantageously, in the method of the invention information on the load-moving device furthermore is transmitted to the mobile operating unit and displayed on the same. Thus, all important data on the load-moving device are available to the person operating the mobile operating unit at any time. Advantageously, this information on the load-moving device also is transmitted to the mobile operating unit and displayed on the same, when the first, advantageously permanently installed operating unit has control over the load-moving device.

The present invention furthermore comprises a method for controlling a load-moving device by at least two persons, with the following steps: controlling the movement of a load-moving device via a permanently installed operating unit by a first person, as long as the same has sufficient view of the load suspension means and/or the load; transferring control over the movement of the load-moving device to a second person operating a mobile operating unit, when the same has a better view of the load-moving element and/or the load; controlling the load-moving device via the mobile operating unit by the second person. With the method of the invention it is possible that the load-moving device can be controlled by two persons safely and efficiently. The load suspension means is a device, by means of which the load can be picked up by the load-moving device and moved, e.g. a crane hook, a cross-beam, a grab or the like.

Advantageously, this method furthermore comprises the following steps: returning the load suspension means by the second person into a position in which the first person has sufficient view of the load suspension means and/or the load, and transferring control over the movement of the load-moving device to the first person. Thus, the second person can for instance position the load in a region which cannot be overlooked by the first person. Upon unloading the load, the second person, which operates the mobile operating unit, then can return for instance the crane hook into a position in which the first operating unit again has a good view of the same. For picking up a further load, control over the load-moving device then can be transferred again to the first person or operating unit.

With the method of the invention it is possible to position a load more safely and efficiently than by the use of banksmen. In particular when the load should be positioned in regions which the machine operator can overlook hardly or not at all from the machine operator cabin, considerable advantages are obtained by the inventive control of the load-moving device by two persons. Especially in use with prefabricated parts, machine parts or in steel skeleton construction this provides considerable advantages.

The present invention furthermore comprises corresponding controllers of a load-moving device with a first, in particular permanently installed operating unit and with a mobile operating unit for controlling the movement of the load-moving device for the safe and efficient performance of the method.

The mobile operating unit advantageously has a transfer function for transferring control over the movement of the load-moving device from the mobile operating unit to the first operating unit. With such controller it is possible in accordance with the invention to employ two machine operators for controlling the load-moving device and to correspondingly transfer control over the movement of the load-moving device. The person which in known cranes merely is used as banksman can directly move the load-moving device by means of the mobile operating unit, instead of merely conveying the commands for this to the crane operator. For moving the load in regions which can be overlooked better from the machine operator cabin, which usually is mounted on the load-moving device and hence in an elevated position, control over the movement of the load-moving device then can be transferred again from the mobile operating unit to the first operating unit.

Due to this alternate control of the load-moving device by two operating persons it is possible on the one hand to work very efficiently over a large range and on the other hand nevertheless ensure a safe and exact positioning of the load.

Transferring control over the movement of the load-moving device advantageously requires a control command, which is generated by actuating the transfer function of the mobile operating unit. Thus, transfer only is possible with the aid of the mobile operating unit, since it is ensured only in this way that the load-moving device constitutes no risk for the person with the mobile operating unit positioned in the vicinity of the load, which just cannot be seen from the machine operator cabin.

Furthermore advantageously, the transfer function of the mobile operating unit also serves for transferring control over the movement of the load-moving device from the first operating unit to the mobile operating unit. Hence, the person operating the mobile operating unit can decide on his own whether to take over or hand over control over the load-moving device. This provides for a safe and efficient division of labor between the two machine operators, wherein the machine operator operating the mobile operating unit, who is positioned in the working area of the load-moving device, is protected against operating errors of the machine operator operating the first operating unit by the transfer function in accordance with the invention.

Furthermore advantageously, further operating units can be used in the present invention, so that in the case of particularly complicated load movements the load is moved by three or more machine operators one after the other. For this purpose, one or all mobile operating units advantageously have a transfer function for transferring control over the movement of the load-moving device.

Furthermore advantageously, control over the movement of the load-moving device always is assigned to only one operating unit. In this way, the machine operators each control the movement of the load-moving device in their working area alone, so that efficient work is possible here, in which the machine operators do not disturb or impede each other.

Furthermore advantageously, the first operating unit also has a transfer function. In this way, it is also possible for the first machine operator to transfer control, e.g. by handing over control or, when the second machine operator has handed over control, taking over control. In particular, the operating units thus can collaborate in the transfer of control with equal rights.

Advantageously, the transfer function includes a handover function and/or a takeover function for handing over and/or taking over control over the movement of the load-moving device. In this way, the machine operator executing control can hand over the same by actuating the handover function, or the machine operator who should take over control can take over control by actuating the takeover function. Control each is withdrawn from the one operating unit and assigned to the other operating unit, e.g. by deactivating or activating the actuators for initiating the machine movements at the operating units. In particular, a plurality of mobile operating units thus can easily be employed one beside the other, wherein one of the inactive operating units each can take over control when the same has been handed over by the active operating unit.

However, the transfer function also can represent a master function, via which control can be transferred to further operators and can again be withdrawn from the same. The master function of the mobile operating unit constantly is in contact with the controller of the load-moving device and is active, even if the first operating unit has control over the movement of the load-moving device. Hence, the machine operator operating the mobile operating unit can decide at any time who should have control over the movement of the load-moving device. If a plurality of mobile operating units are used, only one mobile part advantageously takes over the master function, by means of which control over the movement of the load-moving device can be transferred to all further operating units.

The present invention furthermore comprises a controller of a load-moving device, which includes a first, in particular permanently installed operating unit and a mobile operating unit for controlling the movement of the load-moving device. In accordance with the invention, the mobile operating unit includes an emergency stop function, which can also be activated when the first operating unit has control over the movement of the load-moving device. Thus, it is possible at any time for the machine operator operating the mobile operating unit to trigger an emergency stop of the load-moving device. In this way, he can prevent damages and injuries due to a maloperation of the load-moving device by the other machine operator, even if the first operating unit, and not the mobile operating unit has control over the movement of the load-moving device. Hence, control over the movement of the load-moving device, which advantageously is assigned to only one operating unit each or can be handed over from one operating unit to the other, merely comprises the normal operation of the load-moving device, whereas the emergency stop function advantageously is implemented separately and is not handed over together with the remaining control. The mobile operating unit thus is in contact with the controller during the entire operation, so that intervention is possible at any time also from the mobile operating unit.

It is quite obvious that such emergency stop function also provides for a safe and efficient control by two machine operators when the mobile operating unit has no transfer function, since the person operating the mobile operating unit nevertheless is able at any time to trigger an emergency stop. Advantageously, however, it is provided in the present invention that the mobile operating unit includes a transfer function beside the emergency stop function.

Furthermore advantageously, the emergency stop function of the mobile operating unit cannot be switched off via the first operating unit. In this way, it is ensured that the possibility of triggering an emergency stop of the load-moving device is not inadvertently switched off by the machine operator operating the first operating unit. For this purpose, the emergency stop function advantageously is implemented separate from the remaining controller.

Furthermore advantageously, the first operating unit also includes an emergency stop function, which can also be activated when the mobile operating unit has control over the movement of the load-moving device, and which advantageously cannot be switched off via the mobile operating unit. This also involves the advantage that the emergency stop can also be triggered at any time by the person operating the first operating unit. Advantageously, both operating units have a corresponding emergency stop function. It thus is ensured that an emergency stop of the load-moving device can be triggered at any time by both machine operators.

The emergency stop functions advantageously are arranged in a separate emergency stop circuit and thus implemented separate from the remaining controller.

The controller in accordance with the invention furthermore advantageously comprises a safety function, which permits a transfer of control over the movement of the load-moving device only when the state of movement of the load-moving device lies within a predetermined range. With such safety function it is ensured that control is not transferred at a time when the state of movement of the load-moving device makes a safe transfer impossible. For instance, transfer of control during a fast movement of the load-moving device would be extremely dangerous, so that this should be prevented by the safety function.

Furthermore advantageously, the controller therefore includes a safety function, which for transferring control over the movement of the load-moving device stops the movement of the load-moving device. The safety function advantageously is activated in that control is handed over by the active operating unit. Thereupon, the safety function stops all machine movements in a controlled way, whereupon control can be taken over by an inactive operating unit.

Furthermore advantageously, the mobile operating unit of the controller of the invention includes a display unit, wherein a back channel is provided, via which information on the load-moving device is transmitted to the mobile operating unit, which then is also represented on the display unit. In this way, it is possible that the display instruments necessary for monitoring the machine are available for the machine operator operating the mobile operating unit on the mobile operating unit. This ensures safe control over the load-moving device both via the first and via the mobile operating unit.

Advantageously, all safety-relevant information on the load-moving device is represented on the display unit. Thus, all necessary (and prescribed) information on the load-moving device is available for the machine operator operating the mobile operating unit.

Furthermore advantageously, the back channel and the display unit also are active when the first operating unit has control over the movement of the load-moving device. As a result, the machine operator operating the mobile operating unit has all important information on the load-moving device at his disposal at any time and can intervene, even if the first operating unit actually has control. Thus, safety can again be increased.

Furthermore advantageously, the first operating unit also includes a display unit, which displays information, in particular all safety-relevant information on the load-moving device.

Furthermore advantageously, the display unit of the first and/or second operating unit indicates whether the first and/or the second operating unit has control over the movement of the load-moving device, and advantageously whether control can be taken over. Thus, the machine operators always know who is in control or whether control can be taken over by them.

Advantageously, all safety-relevant information is displayed on both operating units, so that control of the load-moving device also is possible via one of the two operating units alone.

The present invention thus provides two equivalent operating units, by means of which the load-moving device each can be controlled without a reduction in safety. Advantageously, the load-moving device also can be operated alone via the first operating unit or the mobile operating unit.

Advantageously, the mobile operating unit in the controller of the invention is a radio remote control. This provides a maximum of mobility for the machine operator operating the mobile operating unit, who can move around freely.

Advantageously, the controller of the invention comprises a central control unit which receives data from the operating units and from sensors and activates the actuators of the load-moving device. Advantageously, the control unit furthermore transmits data to the mobile operating unit via a back channel. The control of the load-moving device thereby is effected centrally via the control unit, whereas the operating units merely emit control pulses to the central control unit and display information on the load-moving device.

Furthermore advantageously, the mobile operating unit merely comprises operating elements, transmitters and advantageously receivers and display elements, whereas the remaining actuating electronics is located in the central control unit. Thus, merely control pulses are transmitted from the mobile operating unit to the central control unit, so that data streams between mobile operating unit and central control unit can be relatively small. Moreover, the mobile operating unit thus can be constructed relatively compact.

Furthermore advantageously, when the load-moving device is put into operation, the mobile operating unit first is activated, before the load-moving device is started. Thus, when putting the load-moving device into operation, it must already be decided whether control should be effected via the mobile operating unit (possibly in alternation with the first operating unit), or whether control only is effected via the first operating unit.

Advantageously, the first operating unit includes a preselection switch, by means of which a choice can be made between operation via the first operating unit only and operation via the first and the second operating unit, when the load-moving device is put into operation. In particular, the emergency stop function of the mobile operating unit first is activated, so that the same is available at any time. On the other hand, switching on the mobile operating unit during operation of the load-moving device is impossible, which in turn increases safety. Furthermore advantageously, when starting up the load-moving device, the mobile operating unit initially has control over the movement of the load-moving device.

The present invention will now be illustrated in detail with reference to an embodiment and the drawings, in which:

DETAILED DESCRIPTION

The controller of the present invention is used in a crawler crane, in which the control station arranged in the crane operator cabin, which represents the first operating unit, is very far away from the load to be positioned, so that for certain tasks actuation can be effected more favorably via the second, mobile operating unit.

Figure 1:
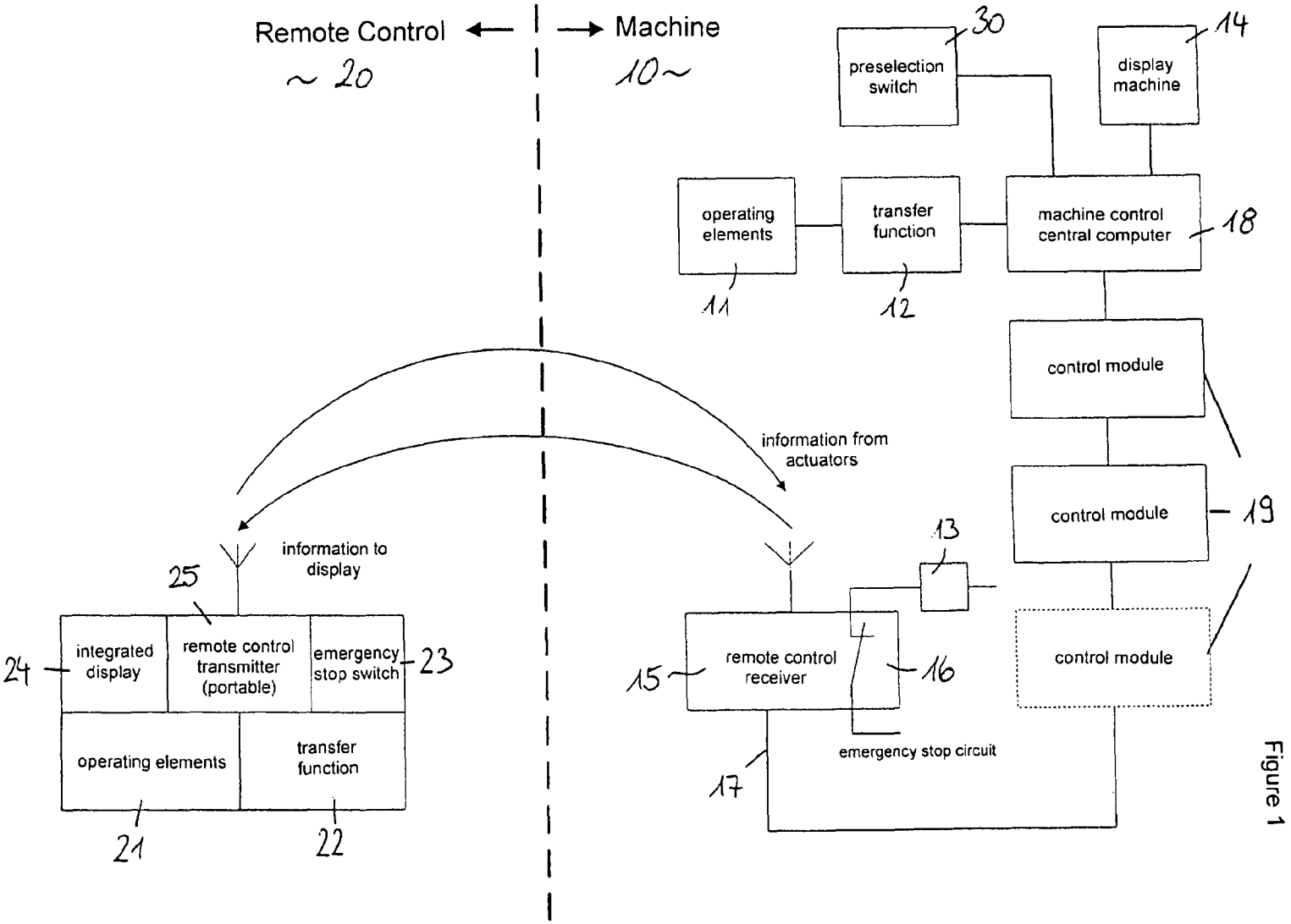
FIG. 1 shows a schematic diagram of an embodiment of the control in accordance with the invention.

FIG. 1 only shows one embodiment of the control of the invention with a first, permanently installed operating unit 10 and a second mobile operating unit 20. Both operating units include operating elements 11, 21 for actuating the movement of the load-moving device, which are configured as corresponding actuators for initiating machine movements. Both operating units likewise include a display 14, 24, on which all information necessary and prescribed for operating the load-moving device is represented. Furthermore, both operating units include an emergency stop switch 13, 23, by means of which an emergency stop of the load-moving device can be initiated. The emergency stop circuit is implemented separate from the remaining controller of the load-moving device, in order to increase safety.

Likewise, both operating units include the transfer function 12, 22 in accordance with the invention, by means of which control over the movement of the load-moving device can be handed over or taken over by actuating the corresponding actuators. For this purpose, both operating units include actuators for actuating the corresponding handover and takeover function.

The permanently installed first operating unit 10 is directly connected with the central computer 19 of the machine controller, which in turn actuates the movement of the load-moving device via control modules 19. The central computer 19 of the machine controller now is connected with a remote control receiver 15 by a connecting line 17, in order to provide for communication with the remote control 20. For this purpose, the remote control 20 includes a remote control transmitter 25. Via the remote control transmitter 25, information can thus be transmitted from the operating elements 21, the transfer function 22 and the emergency stop switch 23 to the remote control receiver 15. Advantageously, however, this is a two-channel system, so that the remote control receiver 15 also includes a transmitter, the remote control transmitter 25 also a receiver. In this way, information can be transmitted from the machine controller 18 to the remote control 20 and be displayed on the integrated display 24.

As is also shown in the circuit diagram, the emergency stop circuit with the emergency stop switch 13 of the first operating unit and with the emergency stop element 16, which is actuated by means of the emergency stop switch 23 of the remote control 20, is implemented separate from the machine control 18.

The first operating unit 10 furthermore includes a preselection switch 30, by means of which a choice can be made between a remote control operation, in which control over the movement of the load-moving device can be transferred to and fro between the first and second operating units, and an operation only via the permanently installed control station 10, when the load-moving device is put into operation. If the remote control operation is selected by the preselection switch 30, the same includes the emergency stop contact 16 of the remote control receiver 15 in the emergency stop circuit and supplies the remote control receiver 15 with electric energy.

Figure 2:
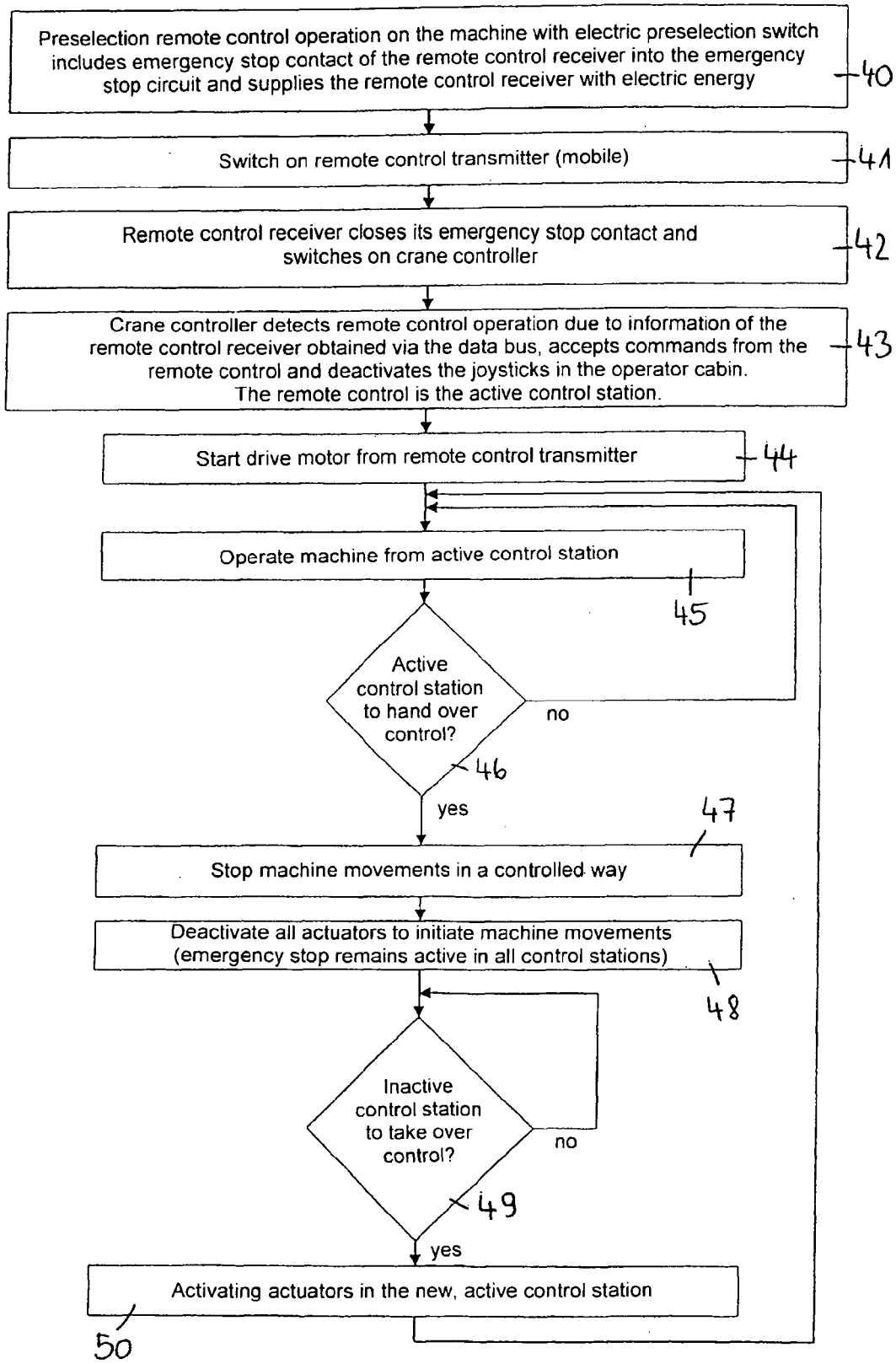
FIG. 2 shows a flow diagram of an embodiment of the method in accordance with the invention.

A flow diagram for operating the load-moving device of the invention is now shown in FIG. 2. When the machine is put into operation, the remote control operation of the invention is selected in step 40 via the electric preselection switch 30, whereby the emergency stop contact 16 of the remote control receiver 15 is included in the emergency stop circuit as described and the remote control receiver 15 is supplied with electric energy. Thereafter, the remote control transmitter 25 of the remote control 20 can be switched on in step 41. If the remote control transmitter 25 is switched on and the remote control receiver 15 receives the corresponding feedback that the emergency stop switch 23 of the remote control 20 is not activated, the same will close its emergency stop contact 16 and switch on the crane controller in step 42. The crane controller detects the remote control operation due to information of the remote control receiver obtained via the data bus 17, accepts commands from the remote control 20 and deactivates the operating elements 11, which advantageously are configured as joysticks, in the operator cabin. The remote control 20 hence is the active control station.

The drive motor now can be started in step 44 via the remote control 20.

In step 45, the machine now is operated from the respectively active control station, wherein actuation either is effected via the operating elements 11 of the first operating unit or via the operating elements 21 of the second operating unit. In a control circuit, it is regularly checked in step 46 whether the respectively active control station wants to hand over control by actuating the handover function of the transfer function 12 or 22. If it is detected that the handover function of the active control station has not been actuated, the routine returns to step 45, so that the machine still is operated from the active control station.

However, if an activation of the handover function of the active control station is detected, the machine movements are stopped in a controlled way in step 47, which can be performed automatically by a corresponding safety function. At the same time, the actuators 21, 11, which serve to initiate machine movements, are deactivated at the respectively active control station in step 48, with the emergency stop functions 23, 13 remaining active, however, in all control stations.

Accordingly, both control stations are inactive, as long as it is detected in step 49 that an inactive control station wants to take over control. This is effected by a corresponding actuation of the takeover function of the transfer function 12, 22. If a corresponding actuation of the takeover function is detected in the inactive control station, the operating elements 11, 21 are activated in the new, active control station in step 50. The routine returns to step 45, in which the machine is operated from the now active control station.

This procedure ensures that misunderstandings and an inadvertent transfer of control over the movement of the load-moving device are excluded, since for transferring control the transfer functions must correspondingly be actuated both on the first and on the second operating unit, so that e.g. by actuating the handover function of the transfer function 22 of the remote control 20, control initially is handed over from the remote control 20, in order to then transfer control to the first operating unit by actuating the takeover function of the transfer function 12 of said first operating unit. On the respective displays 14 and 24, information each is provided to the machine operators, as to which operating unit just is in control, or whether control just has been handed over from the previously active operating unit and hence can be taken over.

Starting up the load-moving device in steps 40 to 44 in accordance with the invention in particular is due to the separate implementation of the emergency stop circuit, since the same must be activated before the drive motor is started. During operation of the load-moving device, it is therefore no longer possible to switch into remote control operation for safety reasons. In addition, if remote control operation is chosen in step 40, control over the movement of the load-moving device initially is assigned to the remote control 20, in order to ensure that the machine operator with the remote control 20, who is present in the working area of the load-moving device, is not endangered.

In the following, it will now be described how in accordance with an embodiment of the method of the invention a crane is actuated in accordance with the invention by two machine operators, in order to be able to move a load corresponding to the respective visibility conditions with the aid of banksmen and a single machine operator much more safely and efficiently than in the prior art by transferring control over the crane.

In the embodiment of the method of the invention, the crane is controlled by the machine operator 1 from the control station as long as the load is present in the field of view of the machine operator 1. As soon as the load can be controlled better by the second machine operator, who is present with the remote control at the positioning point, the same will take over control of the crane by using the remote control. Fine positioning the load now is effected by the machine operator 2.

Both the machine operator 1 and the machine operator 2 are provided with all necessary and prescribed information of the crane, because a display is incorporated in the remote control, which is supplied with information via a back channel from the crane. When the machine operator has done his positioning work, he will move the load suspension means into a position which can be overlooked by the machine operator 1 from the crane cabin and hand over control by actuating the actuator on the remote control, which controls the transfer function. The machine operator 1 now takes over control again and then can attend to lifting the next load, if necessary.

The invention claimed is:

1. A method for controlling a load-moving device with a first, permanently installed operating unit and a second, mobile operating unit by at least two persons, with the following steps:

controlling movement of the load-moving device by a first person via the first, permanently installed operating unit having a first display, transferring control over the movement of the load-moving device to a second person upon receiving two control commands, where a first of the two control commands is a command indicating a desire to hand over control performed by the first person via the first, permanently installed operating unit while the first person is currently exerting control over movement of the load-moving device via the first, permanently installed operating unit and where a second of the two control commands is a command indicating a desire to take over control performed by the second person via the second, mobile operating unit prior to the second person receiving control over the movement of the load-moving device, and controlling the load-moving device by the second person via the second, mobile operating unit, wherein information on the load-moving device is transmitted to the mobile operating unit and displayed thereon via a second display remote from the first display.

2. The method according to claim 1, with the further step: transferring control over the movement of the load-moving device back to the first person and wherein control transfer is effected via the two control commands by which control over the movement of the load-moving device is transferred from the first to the second or from the second to the first operating unit.

3. The method according to claim 2, wherein an emergency stop of the load-moving device can be triggered at any time by the first and/or the second person.

4. The method according to claim 1, further comprising the following steps:

controlling the movement of the load-moving device via the first, permanently installed operating unit by the first person and displaying information for the load-moving device on the first display, transferring control over the movement of the load-moving device to the second person operating the second, mobile operating unit based on a view of a load suspension means and/or a load of the load-moving device that the second person has relative to the first person and displaying information for the load-moving device on the second display, the second display being integrated in the second, mobile operating unit, the control being transferred by performing one or more control commands at the first, permanently installed operating unit while the first, permanently installed operating unit is controlling movement of the load moving device, and controlling the load-moving device via the second, mobile operating unit by the second person.

5. The method according to claim 4, with the further steps:

returning the load suspension means by the second person into a position in which the first person has a view of the load suspension means and/or the load, and transferring control over the movement of the load-moving device to the first person.

6. The method according to claim 1, wherein the second person and the second, mobile operating unit are remote from the first, permanently installed operating unit and a load being moved by the load-moving device.

7. The method according to claim 1, wherein each of the first display and the second display display more than one of: information from display instruments for monitoring the load-moving device of the permanently installed operating unit, information from operating elements of the permanently installed operating unit that actuate movement of the load-moving device, information from operating elements of the mobile operating unit that actuate movement of the load-moving device, and safety-relevant information of the load-moving device.

8. A method for controlling a load-moving device by at least two persons, wherein the load-moving device is a crane with a first, permanently installed operating unit and a second, mobile operating unit, with the following steps:

controlling movement of the load-moving device by a first person via the first, permanently installed operating unit;

transferring control over the movement of the load-moving device to a second person;

controlling the load-moving device by the second person via the second, mobile operating unit;

re-transferring control over the movement of the load-moving device to the first person, where the transferring and re-transferring control is effected via control commands of the first and/or second person, by which control over the movement of the load-moving device is transferred from the first to the second operating unit or from the second to the first operating unit, and where in handing over the control over the movement of the load-moving device during each of the transferring and re-transferring control requires a control command received from one of the first person and second person who is currently exerting control over the movement of the load-moving device, and taking over the control over the movement of the load-moving device during each of the transferring and re-transferring control requires a control command received from one of the first person and the second person who should take over the control over the movement of the load-moving device;

controlling the movement of the load-moving device via the first, permanently installed operating unit by the first person and displaying information for the load-moving device on a first display of the first, permanently installed operating unit;

transferring control over the movement of the load-moving device to the second person operating the second, mobile operating unit based on a view of a load suspension means and/or a load of the load-moving device that the second person has relative to the first person and displaying information for the load-moving device on a second display of the second, mobile operating unit, the second display being integrated in the second, mobile operating unit, the control being transferred by performing one or more control commands at the first, permanently installed operating unit while the first, permanently installed operating unit is controlling movement of the load-moving device;

controlling the load-moving device via the second, mobile operating unit by the second person;

returning the load suspension means by the second person into a position in which the first person has a view of the load suspension means and/or the load; and transferring control over the movement of the load-moving device to the first person, wherein each of the first display and the second display display more than one of: information from display instruments for monitoring the load-moving device of the permanently installed operating unit, information from operating elements of the permanently installed operating unit that actuate movement of the load-moving device, information from operating elements of the mobile operating unit that actuate movement of the load-moving device, and safety-relevant information of the load-moving device, and wherein the second person and the second, mobile operating unit are remote from the first, permanently installed operating unit and a load being moved by the load-moving device.

9. The method according to claim 8, wherein the transferring and re-transferring control over the movement of the load-moving device is effected by a first control command received from the first person operating the first, permanently installed operating unit and a second control command received from the second person operating the second, mobile operating unit and wherein an emergency stop of the load-moving device can be triggered at any time by the first and/or the second person.

* * * * *